US005695188A

United States Patent [19]

Ishibashi

[11] Patent Number: 5,695,188

[45] Date of Patent: Dec. 9, 1997

[54] GAMING MACHINE GENERATING DISTINCT SOUNDS FOR EACH SYMBOL

[75] Inventor: Kazuyoshi Ishibashi, Tokyo, Japan

[73] Assignee: Universal Sales Co., Ltd., Tokyo, Japan

[21] Appl. No.: 577,813

[22] Filed: Dec. 22, 1995

[30] Foreign Application Priority Data

Dec. 27, 1994 [JP] Japan ..... 6-325403

[51] Int. Cl.[6] ..... A63F 5/04

[52] U.S. Cl. ..... 273/143 R; 463/20

[58] Field of Search ..... 463/20, 19, 18, 463/17, 16; 273/143 R, 138 A; 364/410, 412

[56] References Cited

U.S. PATENT DOCUMENTS

| | | | |
|---|---|---|---|
| 4,522,399 | 6/1985 | Nishikawa | 273/143 R |
| 4,695,053 | 9/1987 | Vazquez, Jr. et al. | 273/143 R |
| 5,429,507 | 7/1995 | Kaplan | 273/143 R X |
| 5,472,197 | 12/1995 | Gwiasda et al. | 273/143 R |

FOREIGN PATENT DOCUMENTS

| | | | |
|---|---|---|---|
| 0070613 | 1/1993 | European Pat. Off. | 273/138 A |
| 3242890 | 5/1984 | Germany | 273/143 R |
| 5177042 | 7/1993 | Japan . | |
| 5177053 | 7/1993 | Japan . | |
| 6182025 | 7/1994 | Japan . | |
| 6335559 | 12/1994 | Japan . | |

*Primary Examiner*—Jessica Harrison
*Assistant Examiner*—Michael O'Neill
*Attorney, Agent, or Firm*—Miller, Canfield, Paddock and Stone, PLC

[57] ABSTRACT

A gaming machine comprising variable display means for variably displaying a plurality of symbols for each of a plurality of symbol columns which are moved and stopped in a direction across at least one winning line, and sound generating means for generating sounds when each of the plurality of symbol columns is moved and stopped, respectively. The sound generating means generates different sounds for each of the symbols positioned on the winning line when each of the plurality of symbol columns is stopped. Alternatively, the sound generating means generates different sounds for each of the symbols passing on the winning line while each of the plurality of symbol columns is moved.

5 Claims, 6 Drawing Sheets

| 1ST REEL | 2ND REEL | 3RD REEL |
|---|---|---|
| DO | DO | DO |
| RE | RE | LA |
| MI | FA | RE |
| FA | LA | TI |
| MI | TI | LA |
| SOL | RE | RE |
| LA | MI | MI |
| TI | LA | TI |
| MI | TI | DO |
| RE | RE | LA |
| DO | FA | RE |
| MI | LA | TI |
| SOL | SOL | LA |
| LA | RE | RE |
| TI | FA | TI |
| MI | LA | SOL |
| LA | TI | FA |
| DO | RE | LA |
| MI | MI | RE |
| SOL | LA | MI |
| TI | RE | TI |

FIG. 7

| 1ST REEL | 2ND REEL | 3RD REEL |
|---|---|---|
| DO | DO | DO |
| RE | RE | LA |
| MI | FA | RE |
| FA | LA | TI |
| MI | TI | LA |
| SOL | RE | RE |
| LA | MI | MI |
| TI | LA | TI |
| MI | TI | DO |
| RE | RE | LA |
| DO | FA | RE |
| MI | LA | TI |
| SOL | SOL | LA |
| LA | RE | RE |
| TI | FA | TI |
| MI | LA | SOL |
| LA | TI | FA |
| DO | RE | LA |
| MI | MI | RE |
| SOL | LA | MI |
| TI | RE | TI |

GAMING MACHINE GENERATING DISTINCT SOUNDS FOR EACH SYMBOL

BACKGROUND OF THE INVENTION

1. Field of the Invention

This invention relates generally to gaming machines such as slot machines, and more ballshooting game machines, poker game machines, and the like, and more particularly, to a gaming machine having a variable display block for variably displaying a plurality of symbols by electrically-operated display means such as mechanically driven reels, liquid crystal displays (LCDs), light emitting diodes (LEDs), cathode ray tubes (CRTs), or the like.

2. Prior Art

Referring to a slot machine, for example, a display mechanism of the rotating-reels type is employed as a variable display block. One or more reels are each arranged with a plurality of symbols on peripheral surfaces thereof and are urged into rotation by drive means such as a stepping motor. In play, winning is determined by producing a combination of symbols positioned on a predetermined winning line when rotation of the reels is stopped. In the case of winning, coins or medals are paid out in a number or value which corresponds to the type, or kind, of the win.

In a gaming machine which executes variable displays by the plurality of symbols as mentioned above, the variable displays are controlled by a control unit which consists of electronic circuitry, such as a microcomputer or the like, whereby the probability of winning is not greatly influenced by the skill of a player.

More particularly, in the case of a slot machine when the player operates a lever or pushes a start button, the control unit drives the reels of the variable display block into rotation, and concurrently samples a random number value. Then the control unit determines whether or not the sampled value corresponds to a win by reference to a predetermined winning table. In response to that determination, the control unit selects the symbols (i.e., the stop symbols) which are then displayed in the display windows when the reels are stopped. In addition, the control unit stops rotation of the reels according to stop operations by the player or after a predetermined time period has passed.

Further, referring to the ball-shooting game machine as a pachinko machine and the like, instead of operating the lever or pushing the start button as above, the control unit actuates the variable display block and concurrently samples a random number when a game ball has entered a winning zone called "start hole." Then the control unit determines whether the play is a win. Depending upon the sampled value and the winning table, the control unit determines the stop symbols, and controls the variable displays to a stop after a predetermined time period has passed.

In addition, in a gaming machine comprising a variable display block of video type (e.g., a CRT), graphical data corresponding to patterns of symbols is stored in a memory (symbol ROM) in accordance with a predetermined arrangement, and the control unit reads the graphical data which is to be displayed at the variable display block from the symbol ROM.

When using such gaming machines, the player can readily determine whether he or she has won by viewing the plurality of symbol columns after they have stopped. Therefore, the player observes the displays when each of the symbol columns is stopped with great interest.

Further in regard of the conventional gaming machine of the type having a variable display block, as described above, while the variable displays of the symbol columns are produced at the variable display block, a repetition of a single sound or a predetermined melody is also generated by the gaming machine. When each of the plurality of symbol columns is stopped, the single sound is generated synchronously with the timing of the stop. Also, when all of the symbol columns have stopped and a predetermined winning combination of the symbols has been positioned on the winning line, a fanfare sound or the like, is generated.

In the above-described conventional gaming machine, the sound generated after the variable displays has been stopped is greatly varied and designed to be very interesting. That is, when a big win occurs, a fanfare sound or the like is played. However, irrespective of the particular combination of symbols which is positioned on the winning line in every symbol column, the sound generated when the variable displays are stopped; i.e., at the very moment when the player pays closest attention to the variable displays, it is always the same sound. Additionally, the sound is simply synchronized with the timing when each of the symbol columns is stopped and, therefore, it is not very interesting. Further, as to the sound generated while the variable displays are executed, the same sound resounds all the time or a single melody is repeated; therefore, it, too, is not very interesting.

SUMMARY OF THE INVENTION

It is, therefore, an object of the present invention to provide a gaming machine which generates interesting sounds when variable displays are stopped or while the variable displays are executed.

According to a first embodiment of the present invention, a gaming machine is provided with:

at least one winning line;

a variable display for variably displaying a plurality of symbols for each of a plurality of symbol columns which are moved and stopped in a direction across the winning line; and sound generating means for generating sounds when each of the plurality of symbol columns is moved and stopped, respectively;

wherein the sound generator generates different sounds for each of the symbols positioned on the winning line when each of the plurality of symbol columns is stopped.

In the gaming machine of the first embodiment, the variable displays of symbols are produced by moving the plurality of symbol columns of the variable display in a direction across the winning line, and a player is given a predetermined gaming value corresponding to a kind of a combination of the symbols positioned on the winning line when all the plurality of symbol columns have been stopped. In this variable display operation, the sounds are generated by the sound generator when each of the plurality of symbol columns is moved and stopped, respectively. However, when each of the plurality of symbol columns is stopped, the respective sounds for each of the symbols positioned on the winning line are generated. Therefore, since the player can distinguish the symbols which have been positioned on the winning line in the sounds, it is possible for the player to recognize whether the combination of the symbols is a win merely by listening without seeing, which accordingly increases the interest level of the game.

In the above gaming machine, the sounds generated when each of the plurality of symbol columns is stopped are defined; e.g., as to be different for every kind of the symbols at least in any combination of tone, interval, duration, and octave.

As described above, since the sounds which are generated when each of the plurality of symbol columns is stopped are correspondingly different for each of the symbols, at least with respect to tone, interval, duration, and/or octave, the particular symbols which have been positioned on the winning line become readily distinguishable to the player.

In a further embodiment of the invention, the gaming machine comprises:

stop symbol determining means for determining a combination of the symbols to be positioned on the winning line when each of the plurality of symbol columns is stopped; and symbol determining means for determining whether the combination of the symbols constitutes a win or a loss;

wherein the sound generator produces a sound corresponding to one of the symbols being able to give a major award among the symbols positioned on the winning line when the symbol determining means determines a loss.

After the stop symbol determining means determines which combination of the symbols is to be positioned on the winning line when each of the plurality of symbol columns is stopped, and the symbol determining means determines that the combination of the symbols results in a loss, the sound is generated which is corresponding to one of the symbols being able to give a major award among the symbols positioned on the winning line turned to be effective. Therefore, it is possible to give the player an expectation that he or she may obtain a big award even if winning judgment results in losing.

As described above, according to this invention, the sounds generated when the variable displays have bene stopped are defined correspondingly to the symbols positioned on the winning line in every symbol column. Therefore, the player can distinguish the symbols positioned on the winning line by the sounds when the variable displays have been stopped; i.e., at the very time when the player pays closest attention to the variable displays, which accordingly increases the interest in the game.

According to a second embodiment of the invention, the present invention provides a gaming machine comprising;

at least one winning line;

a variable display means for variably displaying a plurality of symbols for each of a plurality of symbol columns which are moved and stopped in a direction across the winning line; and a sound generator for generating sounds when each of the plurality of symbol columns is moved and stopped, respectively;

wherein the sound generator generates different sounds for every one of the symbols passing on the winning line while each of the plurality of symbol columns is moved.

Also in the gaming machine of the second embodiment, when the variable display means operates, the sounds are generated by the sound generator as each of the plural symbol columns is moved and stopped, respectively. However, in this gaming machine, while each of the symbol columns is moved, the different sounds for each of the symbols passing on the winning line are generated. Therefore, the player can easily distinguish the symbols passing on the winning line and, accordingly, direct his effort toward targeting the symbols he desires to be arranged on the winning line by controlling a stop button as in a slot machine, which accordingly increases the interest for the game.

In the above-described second embodiment, the sounds generated for each of the symbols passing the winning line are predetermined for each kind of symbol at least in regard of tone, interval, duration, and octave.

In addition, the sounds generated for each of the symbols passing the winning line are made to be different for each of the symbols at least in any of tone, interval, duration, and octave. Therefore, the kinds of symbols passing on the winning line can be distinguished audibly by the player.

The different sounds for each of the symbols passing the winning line are generated in the variable display operation, whereby the player efficiently and easily distinguishes the symbols passing the winning line in each symbol column. Also, the player more easily arranges his target symbols on the winning line.

The foregoing and other objects, features, and advantages of the invention will become more apparent from the following detailed description taken in conjunction with the accompanying drawings.

BRIEF DESCRIPTION OF THE DRAWINGS

FIG. 7 is a schematic diagram which is useful for explaining the sounds generated in correspondence with the symbol columns of FIG. 5.

DETAILED DESCRIPTION

The invention will now be described in detail with reference to the drawings showing embodiments thereof.

Figure 1:
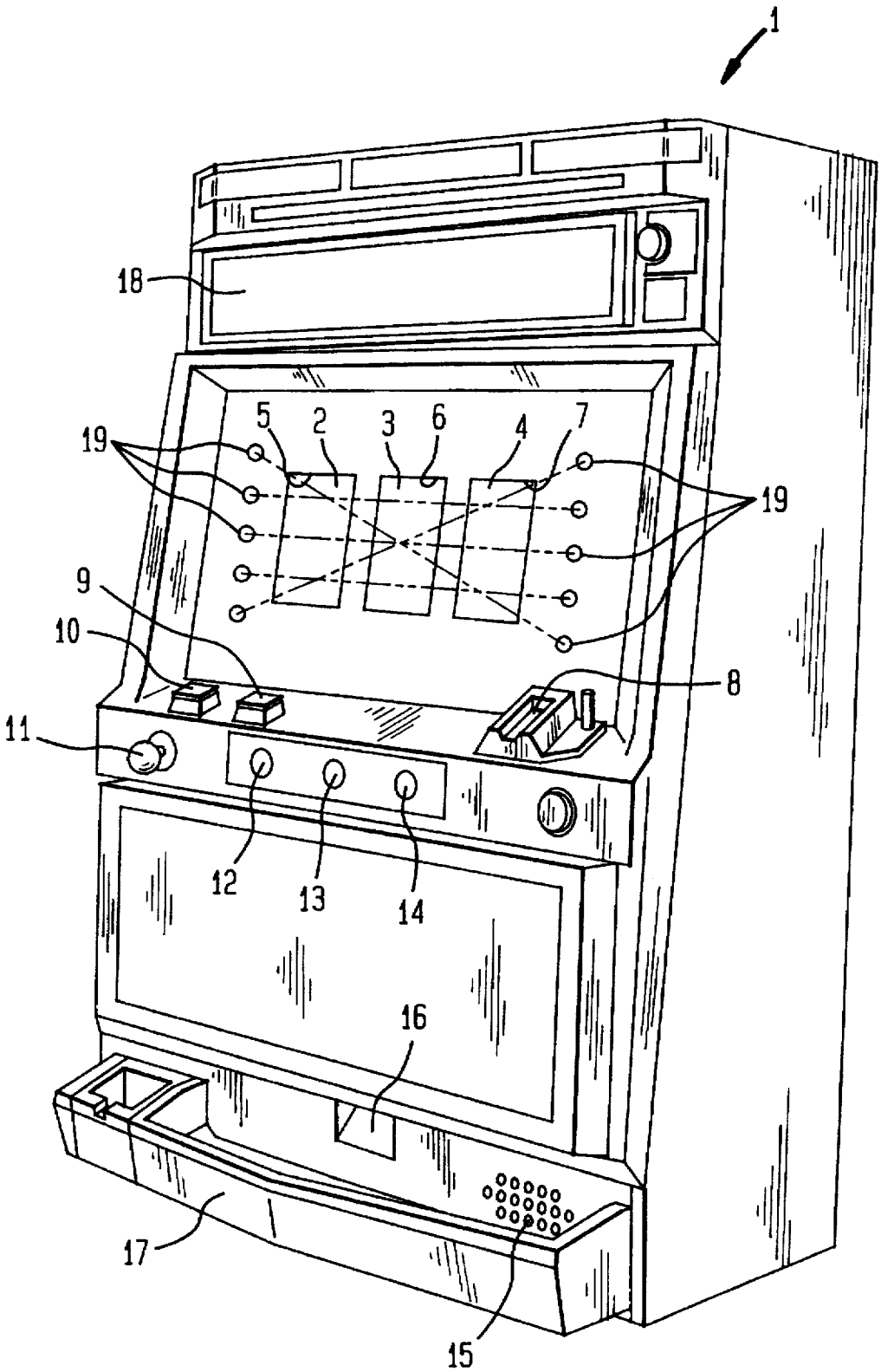
FIG. 1 is a perspective frontal view of a slot machine embodiment of the present invention.

FIG. 1 is a front perspective view showing the overall appearance of the slot machine of the present specific illustrative embodiment of the invention. At the center of a body of a slot machine 1, three rotatable reels 2, 3, and 4 are provided to form a variable display block, with symbol columns which consist of a plurality of kinds of symbols painted on each peripheral surface. Three symbols of each of rotatable reels 2, 3, and 4 can be observed in this embodiment through display windows 5, 6, and 7 on the from face of the body of slot machine 1.

Below the display windows 5, 6, and 6 on the fight side, there is provided an entry slot 8 for the player to insert game media such as coins, medals or substitute currency referred as "token" (hereinafter, the game media are referred to as the "coins"). In addition, on the front face of the body of the slot machine 1, there may be provided a display block (not shown) for displaying the number of coins deposited as credit at present, etc. This display block is formed by a desired number of 7-segment LEDs, for example.

Below display windows 5, 6, and 7, there are disposed a bet switch 9 for betting one, two, or three coins on a play by pushing button-pushing operations; a credit/payout switch 10 which is operated by a button-pushing operation, for changeover between the credit and the payout (PLAY CREDIT/PAY OUT) of the coins acquired by the player; a start switch 11 for starting rotation of the reels 2, 3, and 4 by a lever operation; and stop buttons 12, 13, 14 disposed correspondingly to each reel for stopping rotation of each of the reels 2, 3, and 4 by the operations of the player.

Below the front face of slot machine 1, there are disposed a sound hole 15 for emitting sounds generated by a speaker 36 (FIG. 3) received within the slot machine as sound generating means to the outside, and a coin tray 17 for receiving coins paid out via a coin chute 16 according to switching the above credit/payout switch 10. An upper panel 18 on the front face of the slot machine is provided with an award table (not specifically designated), which shows winning combinations of the symbols and corresponding numbers of coins paid out as awards.

Figure 2:
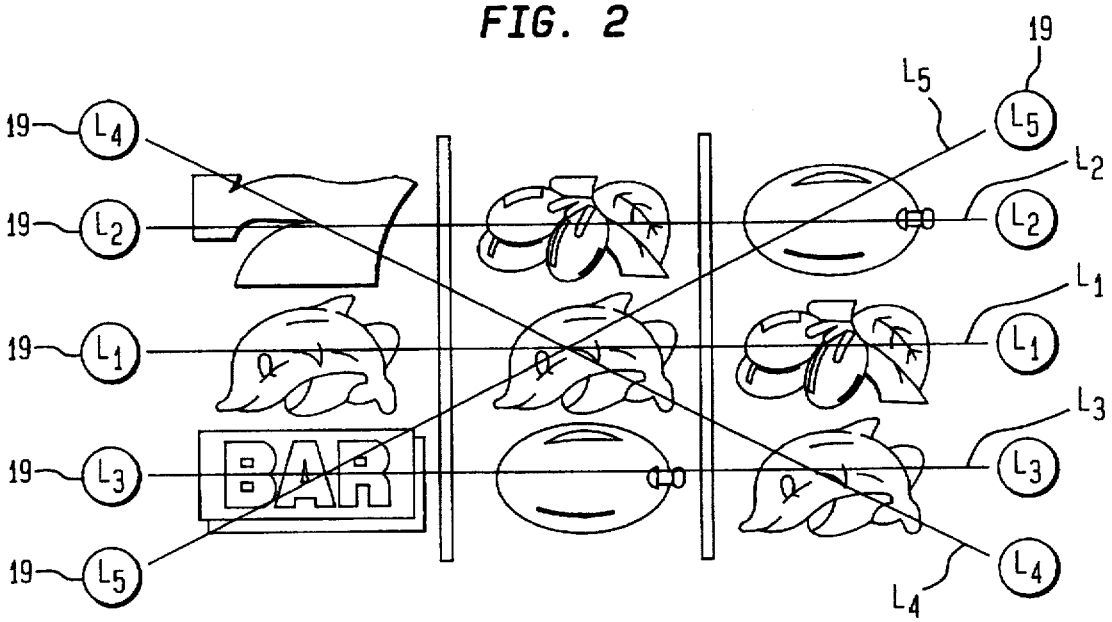
FIG. 2 shows a plurality of symbols positioned on plural winning lines.

At the above display windows 5 to 7, as shown in FIG. 2, there are provided three winning lines $L_1$, $L_2$ and $L_3$ in the horizontal direction. To start the game, the player inserts one coin through coin entry slot 8, only the winning line $L_1$, at center position is turned to be effective. When the player inserts two coins, winning lines $L_2$ and $L_3$ at upper and lower positions are added to the winning line $L_1$. And when the player inserts three coins, all winning lines are made effective. Such effective winning lines are displayed for the player by lightening of effective-line display lamps 19 disposed in both ends of each winning line, respectively.

In slot machine 1, the coins inserted through the coin entry slot 8 are detected by a coin sensor 8S (FIG. 3) disposed within the coin entry slot 8. When the coins are bet by inserting coins or pushing the bet switch 9, the effective-line display lamps 19 are illuminated as described above to display that the winning lines have been made effective.

In the illustrative embodiment, after the player inserts the coins through coin entry slot 8, he operates start lever 11 disposed at a left edge of the from face of the slot machine, which causes the three reels 2, 3, and 4 to rotate together. When rotation reaches a predetermined speed, the operations of the stop buttons 12, 13, and 14 disposed correspondingly to each reel are turned to be effective; therefore, the player can stop the rotation of the corresponding reel by pushing these buttons. Then if any of the combinations of the symbols positioned on the winning lines turned to be effective as mentioned above corresponds to any of the winning combinations, the coins of a number according to the kind of the winning are paid out to the tray 17.

Figure 3:
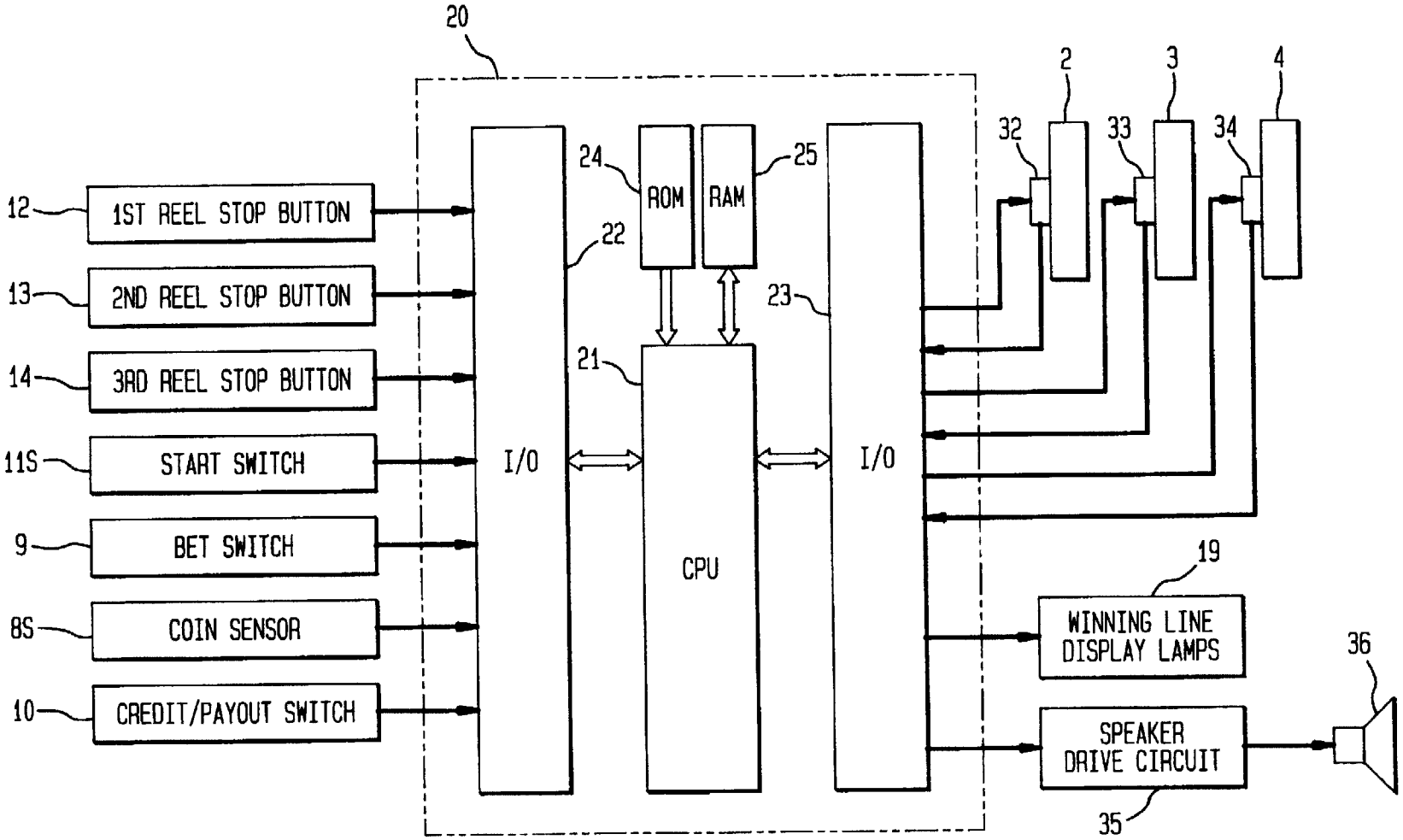
FIG. 3 is a function block diagram showing a circuit structure of the specific illustrative embodiment.

FIG. 3 is a function block representation of a control circuit of the illustrative embodiment. This control circuit operates under the control of a microcomputer 20 including a CPU 21, I/O ports 22, 23, a ROM 24 and a RAM 25 which construct a memory block. In addition, though not shown, connected to the CPU 21 are a clock pulse generator for inputting reference clock pulses (e.g., at a frequency of 4 MHz) to the CPU 21, based on which the CPU 21 operates, and a frequency divider for inputting interruption pulses (e.g., at a frequency of 500 Hz) for enabling an interruption by a predetermined program.

In ROM 24, a program for executing random number sampling as described hereinafter is stored. Otherwise, besides the ROM 24, a random number generator (not shown) generates random numbers to be sampled and a random number sampling circuit may be constructed to be connected to CPU 21.

Further, ROM 24 has a memory block divided for storing a winning probability table, a symbol table, a wining symbol combination table, and a sequence program. The winning probability table contains data corresponding to values of random numbers generated in the random number sampling and divided into groups; e.g., a group of "big winning" and a group of other winnings, according to the size of the values. The symbol table contains data corresponding to position codes of "0 to 20" showing positions of rotation from reference position of each reel as described hereinafter, and corresponding symbol codes showing kinds of the symbols arranged on each reel. In addition the winning symbol combination table contains data corresponding to the combinations of the symbols forming patterns of the big winning and other winnings. In the sequence program, a process of a game program is written.

CPU 21 determines the group to which the value of the random number sampled as described hereinafter belongs by reference to the above winning probability table. If the value belongs to any of the groups of winnings, data (a flag) indicative of the kind of the winning is written in RAM 25. Otherwise, i.e., if the value of the random number does not belong to any of the groups stored in the winning probability table, a flag indicative of "losing" is written in RAM 25. Then the combination of stop symbols to satisfy the flag written in RAM 25 is determined. The determination of the stop symbols is executed before each reel starts to rotate. In this determination, stop position of each of reels 2, 3, and 4 at the time, the symbol table, and the winning symbol combination table are referred to. The stop position of each reel at the time can be distinguished by a counter value of a counter described hereinafter.

Signals from the above-mentioned coin sensor 8S and the switches 9 to 14 are inputted via I/O port 22 to microcomputer 20, respectively. Further, signals from symbol position detectors, not shown, incorporated within reel drivers 32, 33, and 34, including pulse motors (or stepping motors) for driving the above reels 2, 3, and 4, respectively, and motor drive circuits, and a payout coin sensor for detecting the coins paid out from a coin receiving hopper, not shown, disposed within the slot machine 1 are inputted via I/O port 23.

The pulse motors of reel drivers 32, 33, and 34 are controlled in their rotation in response to the numbers of drive pulses supplied from microcomputer 20, and their rotation velocity by pulse intervals of the drive pulses. These numbers of the drive pulses are counted in the counters set on a program correspondingly to each reel, and the counter values are stored in RAM 25.

Further, the detectors for detecting positions of the symbols on the reels rotating as described above consist of photo sensors; e.g., which are provided so as to detect movement of the shading pieces disposed at predetermined positions on each peripheral surface of reels 2, 3, and 4. These photo sensors deliver the pulses for resetting the above counter values stored in the RAM 25 when they detect. That is, when a reset pulse is delivered from a corresponding photo sensor, the counter value of the counter is reset as "0." Therefore, the counter value of each counter corresponds to rotation angle of each reel in the range of one rotation. Since orders of the symbols arranged at a certain pitch on each reel are known, if the rotation angle of each of reels 2, 3, 4 from the reference position is found by the counter value of each counter, each of the symbols positioned on the winning line at the time can be distinguished.

Further, the counter value of each counter corresponds to code number "0 to 20" (FIG. 5) indicative of the positions of the symbols of each reel as described hereinafter, and it is updated to be recorded in RAM 25 at every counter. CPU 21 can acquire the positions of the symbols rotating on each of reels 2, 3, and 4 in the range of one rotation by the counter values stored in RAM 25 and the symbol table stored in ROM 24.

Among the above sensors and switches of the input side, coin sensor 8S detects proper coins inserted via coin entry slot 8 of FIG. 1 and selected by a coin selector, not shown, and may be suitably formed by a contact-type detector, such as a microswitch, as well as a non-contacting type, such as a magnetic sensor or an optical sensor.

Start lever 11 includes a start switch 11S which is turned on or off in an interlocked manner with the operation of the lever for generating a start signal from CPU 21 for driving the reels into rotation when the player has operated the lever.

The credit/payout switch 10 is disposed, as described above, at the front face of slot machine 1, and is manually operated for changeover between the credit side and the payout (settlement) side.

CPU 21 of microcomputer 20 receives the input signals from the above various sensors and switches and stores them as data in the RAM 25. Microcomputer 20 supplies drive control signals to the pulse motors of the reel drivers 32, 33, and 34 for controlling each of reels 2, 3, and 4 to drive into rotation or to stop and display signals to the winning line display lamps 19 for displaying the winning lines which have been made effective, as described above. Further, microcomputer 20 supplies a speaker drive signal to a speaker drive circuit 35 for generating predetermined sounds by the speaker, as described hereinafter and, in addition, a payout signal to driving means of a coin dispensing apparatus for paying out coins from the hopper, respectively.

Next, there will be described the operations controlled by the microcomputer 20 in the above-mentioned embodiment.

Figure 4:
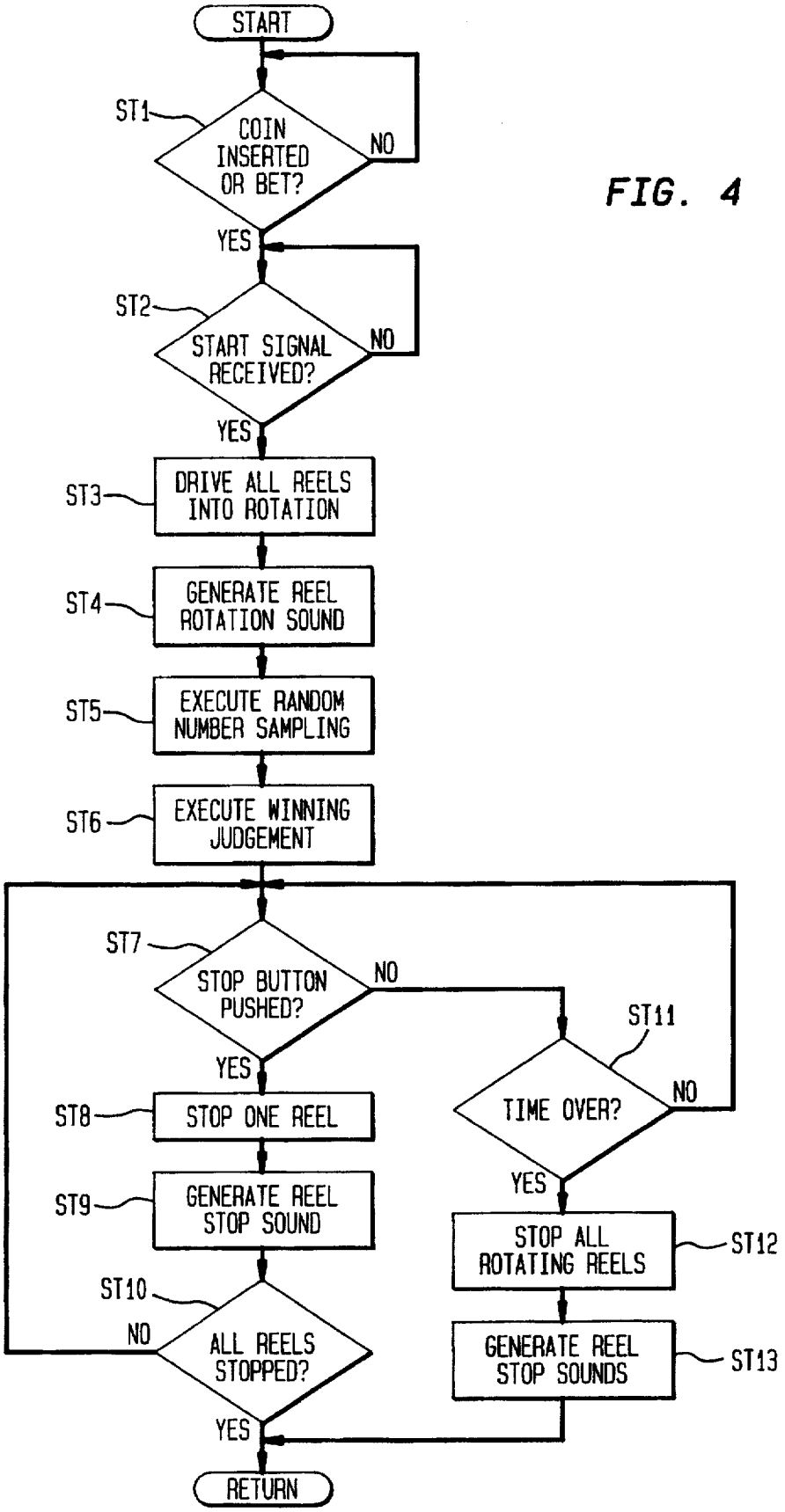
FIG. 4 is a flow chart showing the operations under the control of a control block of the specific illustrative embodiment.

Referring to FIG. 4, the CPU 21 determines first whether or not coin BET is executed (at step ST1). The answer to this determination becomes "YES" when the coin has been inserted into the coin entry slot 8 and coin sensor 8S has delivered a detection signal to CPU 21, or when the bet switch 9 has delivered a signal to CPU 21. In that case, it is then determined whether or not the start switch 11S has delivered a signal (the start signal) to CPU 21 by operating the start lever (at step ST2). If the answer to this question is "YES," CPU 21 supplies drive signals to reel drivers 32, 33, and 34 via I/O port 23 to drive all reels 2, 3, and 4 into rotation (at step ST3).

Figure 6:
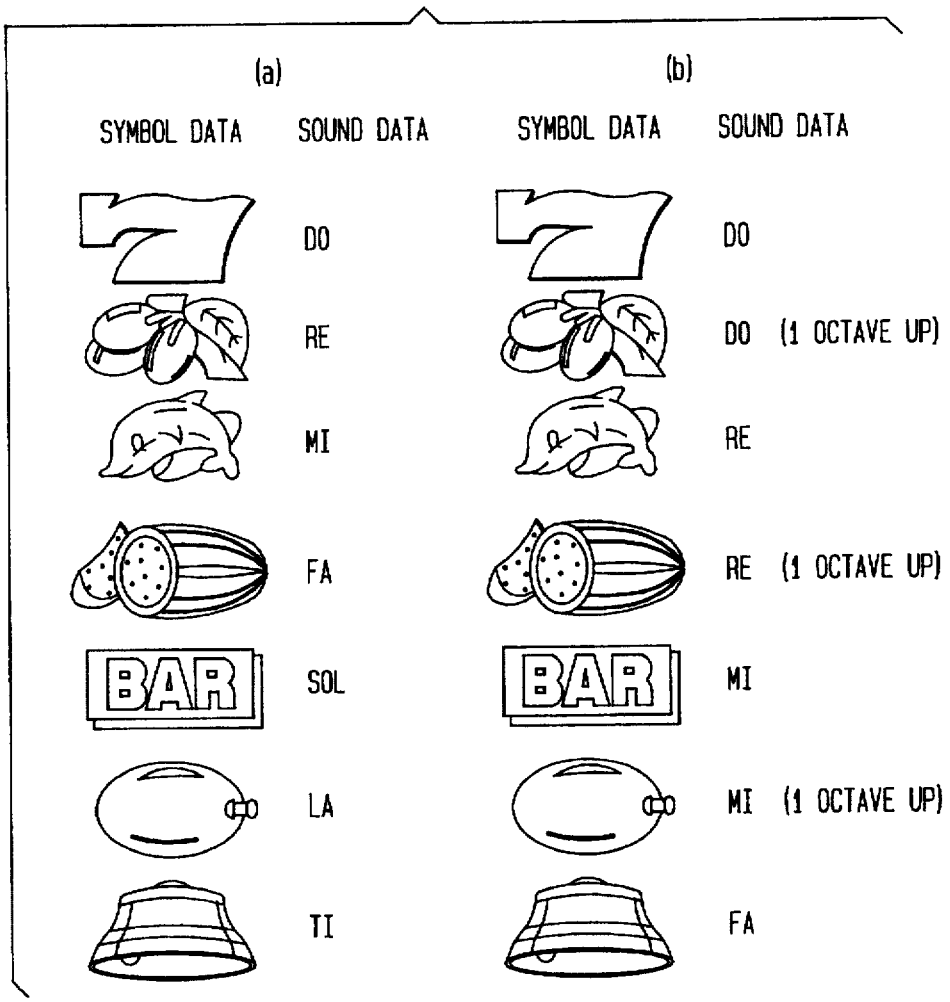
FIG. 6 is a schematic representation showing a correlation of kinds of symbols and corresponding sounds generated in the specific illustrative embodiment of the invention.
Figure 5:
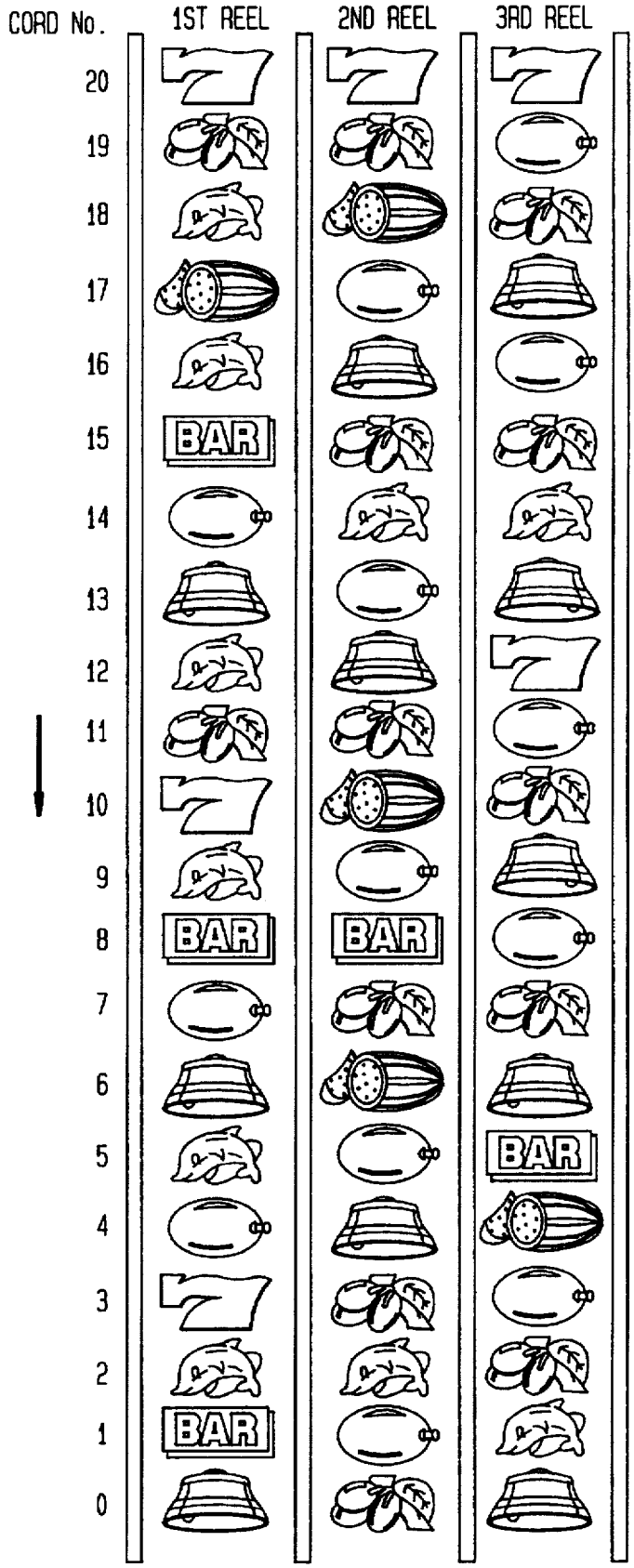
FIG. 5 is a schematic representation showing an example of the symbol columns which are to be disposed on first, second, and third reels.

On the peripheral surface of each of reels 2, 3, and 4, the signals, e.g. of twenty-one as shown in FIG. 5 (of seven kinds as shown in FIG. 6[*a*]), are arranged to form the symbol columns. Each symbol has a code number of "0 to 20" stored in ROM 24 as a data-table. Each of reels 2, 3, and 4 is driven into rotation in the direction (downward from above) as designated by an arrow in FIG. 5.

CPU 21 drives reels 2, 3, and 4 into rotation, and also supplies a predetermined drive signal to speaker drive circuit 35 for generating a reel rotation sound by speaker 36 (at step ST4). The operations for generating the reel rotation sound are executed as follows. First, when each symbol on one of the three reels passes a predetermined winning line (e.g., $L_1$), CPU 21 determines which symbol passes by a detection signal from the above-mentioned detector for detecting positions of the symbols (e.g., a photo sensor provided correspondingly to each reel). On the other hand, as shown in a schematic view of FIG. 6 (*a*), since the table of data of the symbols and the corresponding sounds is stored in ROM 24, CPU 21 determines from the table of FIG. 6(*a*) the sound corresponding to the symbol determined as has passed the winning line as mentioned above, and supplies the drive signal to generate the sound.

On this occasion, when all symbol reels are arranged as shown in FIG. 5, the sounds of "do, re, mi, fa, sol, la, ti" correspond to every kind of the symbols of each reel, as shown in FIG. 6(*a*). Therefore, when the reel is rotated, a melody sound is generated which varies in order; e.g., as "ti" →"la"→"sol," upward from below of FIG. 7. This melody sound may be generated for one reel (e.g., the first reel) through the whole game, or the sound may be generated in a predetermined order (e.g., the first →second→third reel) at every play.

In this embodiment, since the generated sound and the symbol passing on the predetermined winning line are corresponding to each other as described above, it is easy for the player to distinguish the symbols passing on the winning line and also to aim a predetermined symbol to stop by the stop button. Therefore, the game becomes more interesting.

As shown in FIG. 4 again, the CPU drives reels 2, 3, and 4 into rotation (at the step ST3), and also executes the random number sampling (at step STS). The random number sampling is executed by storing a numerical value in the RAM 25 and reading out the numerical value stored in RAM 25 every time the interruption operation occurs. The numerical value is obtained by adding a predetermined number (e.g., "3") to an integer within a predetermined limit (e.g., "0" to "127"), which occurs from an R register in CPU 21 every time the reference clock pulse is received from the clock pulse generator. Further, the numerical value stored in RAM 25 is updated every time the reference pulse is inputted.

Next, the winning judgment is executed, based on the random number value sampled as described above (at step ST6). The winning judgment is executed by comparing the winning probability table stored in ROM 24 and the sampled random number value, and a flag (which indicates winning or losing, e.g.) is set in RAM 25 according to the result of the winning judgment. In the case of winning, the kind of the winning (e.g., whether it is "big winning" or another winning) is also judged, and a winning game routine according to the result of the judgment is executed.

Afterward, it is determined whether or not either of stop buttons 12 to 14 has pushed (at step ST7). If the switch is turned on, the reel corresponding to the stop button is controlled to stop (at step ST8), and then, the reel-stop sound is generated (at step ST9).

Here, n the case that the player has inserted one coin, the winning line turned to be effective is only $L_1$. Therefore, the stop sounds of the symbols which have been positioned on the winning line $L_1$, are generated; e.g., by reading out of the table shown in FIG. 6(*a*).

In the case that the player has inserted two or more coins, the effective winning lines are two or more. If all sounds of the symbols positioned on those winning lines are generated, the nine sounds will be generated in all; therefore, it is difficult for the player to distinguish them. Then it is preferable that the sound of the symbol, which forms the combination of the symbols generated when all reels are stopped (i.e., the combination of the symbols to be positioned in the present play) based on a result of the above winning judgment (at the step ST6), is generated when the symbol of each reel has been positioned on the effective winning lines. Further, in the case that such symbol as forms the combination of the symbols to be positioned in the present play has not been positioned on the effective winning lines, or in the case that the winning judgment results in losing, it is preferable that the sound for one of the symbols being able to give a big award to the player among the symbols which have been positioned on the winning lines is generated.

For example, in the case that the combination of the symbols to be positioned this time according to the above winning judgment is a winning pattern of "dolphin-dolphin-dolphin," when first reel 2 on the left has been stopped as shown in FIG. 2, the sound of "mi" corresponding to "dolphin" is generated as the stop sound. On the other hand, in the case that the winning judgment results in losing, when first reel 2 has been stopped as shown in FIG. 2 and the three winning lines $L_1$ to $L_3$ have been turned to be effective, the stop sound of "do" corresponding to "7" being able to give the biggest award among the symbols (of three, in this case) positioned on those winning lines is generated.

In such construction, when the winning judgment results in winning, the player can be announced that, and also when the winning judgment results even in losing, the player can have the expectation that the symbols which bring him a big award may stand on the winning line.

Next, it is determined whether all reels have been stopped or not (at step ST10). When all reels have not been stopped yet, the operations return to the determination of the stop-button pushing operation (at the step ST7).

When steps ST7 to ST10 are repeated as described above and all reels have bene stopped, if the combination of the symbols generated according to the timing of the stop-button pushing operations is the above "dolphin-dolphin-dolphin," based on the result of the winning judgment at step ST, the stop sounds generated when each reel is stopped become "mi," "mi," "mi" in order. Therefore, the player knows that the play has become winning without seeing the symbols.

On the other hand, though the winning judgment results in winning, when the symbols of the above winning pattern have not been positioned on the winning line in a row because of the bad timing of the stop-button pushing operations; e.g., when the three reels have been stopped as shown in FIG. 2, the stop stounds generated when each reel is stopped become "mi", "mi", "re" in order. Therefore, the player knows that the play has become losing without seeing the symbols.

Further, when there is no button-pushing operation at the determination of the above stopbutton pushing operation (at the step ST7), it is determined whether a predetermined time period has passed (at step ST11). In the case that the time is over (i.e., when the stop buttons are not operated even though the predetermined time period has passed), all rotating reels (the number of rotating reels may also be one or two) are stopped in the order of the first→second→third reel (at step ST12). On this occasion, the combination of the symbols to be positioned on the winning line is determined according to the result of the above winning judgment, and the reel stop sounds are generated in a same manner as above (at step ST13).

After all reels have been stopped as described above, the operations of FIG. 4 return to the start position and are made ready for the next play.

In the above embodiment, since the symbol passing sound and the symbol stop sound corresponding to each symbol are generated being base don the table shown in a schematic view of FIG. 6(*a*), those sounds have the same interval if the corresponding symbols are same. However, as shown in FIG. 6(*b*), those sounds may have same interval but have different octave for every kind of the symbols. Therefore, the player knows whether the stop combination becomes "winning" or "losing" without seeing the stop symbols when the reels are stopped.

In the above first embodiment, since the symbol passing sound and the symbol stop sound corresponding to each symbol are generated being based on the table shown in FIG. 6(*a*), those sounds have the same interval if the corresponding symbols are same. However, same symbols may have the same interval but have a different octave for every reel.

In addition, as another embodiment, even if all symbols have the same interval and the same octave, it is possible to have the same effect as the above embodiment by changing tone (as a whistle, a horn, sounds of various music instruments, and the like) for every kind of the symbols.

Further, even though all symbols have the same octave, the same tone, and the same interval, the duration may be different for every symbol.

This invention may be applied to gaming machines which execute movement and stop of the symbol columns by electrical display means, such as the LCD, the LEDs, the CRT, besides mechanical variable displays by driving the reels as above embodiments.

Further, the invention may also be applied to a gaming machine which has no reel-stop button as the embodiment. In that case, since the combination o the symbols to be positioned on the winning line is determined being based on the result of the winning judgment and is controlled to be positioned after a predetermined time period has passed, the stop sound is also decided automatically.

In addition, the number of the symbols which form one symbol column and the number of the symbol columns may not be limited as shown, but may be provided as desired. The number of the winning lines should be one or more. However, if the number of the winning line is one, sound signals corresponding to the symbols on the winning line may be generated while the reels are rotated and also when they are stopped.

Although the invention has been described in terms of specific embodiments and applications, persons skilled in the art can, in light of the teaching herein, generate additional embodiments without exceeding the scope or departing from the spirit of the claimed invention. Accordingly, it is to be understood that the drawings and description in this disclosure are proffered to facilitate comprehension of the invention and should not be construed to limit the scope thereof.

What is claimed is:

1. A gaming machine comprising:

at least one winning line;

variable display means for variably displaying a plurality of symbols for each of a plurality of symbol columns which are moved and stopped in a direction across said winning line; and sound generating means for generating sounds when each of said plurality of symbol columns is moved and stopped, respectively;

wherein said sound generating means generates different sounds for each of said symbols positioned on said winning line when each of said plurality of symbol columns is stopped.

2. The gaming machine according to claim 1, wherein said sounds generated when each of said plurality of symbol columns is stopped are different for every kind of said symbols at least in any of tone, interval, duration, and octave.

3. The gaming machine according to claim 1, further comprising:

stop symbol determining means for determining a combination of said symbols to be positioned on said winning line when each of said plurality of symbol columns is stopped; and symbol judgment means for judging whether said combination of said symbols is winning or losing;

wherein said sound generating means generates a sound corresponding to one of said symbols being able to give a major award among said symbols positioned on said winning line when judgment of said symbol judgment means results in losing.

4. A gaming machine comprising:

at least one winning line;

a variable display means for variably displaying a plurality of symbols for each of a plurality of symbol columns which are moved and stopped in a direction across said winning line; and a sound generating means for generating sounds when each of said plurality of symbol columns is moved and stopped, respectively;

wherein said sound generating means generates different sounds for every one of said symbols passing on said winning line while each of said plurality of symbol columns is moved.

5. The gaming machine according to claim 4, wherein said sounds generated for each of said symbols passing on said winning line are different for every kind of said symbols at least in any of tone, interval, duration, and octave.

* * * * *